US005606888A

United States Patent [19]

Grabbe

[11] Patent Number: 5,606,888

[45] Date of Patent: Mar. 4, 1997

[54] METHOD OF FORMING RELATIVELY HARD MATERIALS

[75] Inventor: Dimitry Grabbe, Middletown, Pa.

[73] Assignee: The Whitaker Corp., Wilmington, Del.

[21] Appl. No.: 502,647

[22] Filed: Jul. 14, 1995

[51] Int. Cl.[6] ..... B21D 22/06; B21J 7/30

[52] U.S. Cl. ..... 72/443; 72/355.4; 72/358

[58] Field of Search ..... 72/355.4, 358, 72/443

[56] References Cited

U.S. PATENT DOCUMENTS

| | | | |
|---|---|---|---|
| 2,861,335 | 11/1958 | Huet | 72/358 |
| 2,898,788 | 8/1959 | Baxa | 72/355.4 |
| 3,365,926 | 1/1968 | Price | 72/358 |
| 3,730,039 | 5/1973 | Fedrigo | 83/170 |
| 4,213,323 | 7/1980 | De Deugd | 72/358 |
| 5,159,826 | 11/1992 | Miyazawa et al. | 72/358 |

FOREIGN PATENT DOCUMENTS

| | | | |
|---|---|---|---|
| 0452541A2 | 10/1991 | European Pat. Off. | B21D 22/20 |
| 40073 | 3/1980 | Japan | 72/358 |

OTHER PUBLICATIONS

Dreis & Krump Manufacturing Co., "Select–a–Speed", The Iron Age, p. 104 Oct. 1964.

Patent Abstracts of Japan: vol. 13, No. 552 (M–903), Dec. 1989 and JP, A, 12 028616 (Sky Alum), 12 Sep. 1989.

*Primary Examiner*—David Jones

[57] ABSTRACT

A method of forming relatively hard materials is disclosed. The method includes providing tooling for performing the forming operation on a strip (10) of relatively hard material. The tooling includes a forming tool (22) and a mating die (24) coupled to a high speed stamping and forming machine (70). The tooling and machine are arranged so that the forming operation is performed within a time period that is less than the stress relaxation time constant for the material being formed.

9 Claims, 5 Drawing Sheets

METHOD OF FORMING RELATIVELY HARD MATERIALS

The present invention is related to the forming of relatively hard materials in a stamping and forming machine and more particularly to the forming of such materials without adverse effects such as fracturing at or near the forming site.

BACKGROUND OF THE INVENTION

In the forming of certain relatively hard materials using procedures and apparatus that are current in the industry, the deformation of the material caused by the forming operation must be above some minimum value or fracturing of the material at or near the deformation will occur. For example, in the case of bending, either the radius or the degree of bend must be above some minimum value. It is commonly believed that the material work hardens as the forming takes place and then fractures as bending continues and the elastic limit of the material is exceeded at the work hardened area. Heat treatment procedures have been developed for some materials, such as hard aluminum alloy used in the aircraft industry that, coupled with the forming operation, allow limited forming without fracturing. However, these procedures are cumbersome, expensive to implement, and limited to a few relatively hard materials. Certain materials, however, cannot be meaningfully formed at conventional stamping and forming speeds and there are no heat treatment procedures available that will enable these materials to be easily formed. An example of such a material is Paliney 7, a high strength palladium gold alloy, in its full hard condition of about 195,000 pounds per square inch ultimate tensile strength, manufactured by J. M. Ney Company of Hartford, Conn. The forming of this material at normal stamping and forming speeds is limited to a certain minimum radius, however, as will be explained below, forming of this material to a much smaller radius is possible utilizing the method taught by the present disclosure. It is known that certain explosives can be utilized to successfully form some relatively hard materials. For example, Lead Azide, which has a shock wave velocity of over 20,000 feet per second has been used to bend and even weld materials that would generally fracture when bending and forming is attempted using conventional processes and equipment. This procedure is generally used with relatively large components such as ends for large tanks, autoclaves, boilers and similar structures. However, the use of explosives to form small parts such as electrical contacts for electrical connectors is unknown and deemed impractical.

What is needed is a method of easily forming these relatively hard materials in the manufacture of relatively small parts such as electrical contacts without resorting to complex heat treatment procedures or methods that employ dangerous explosives. Manually bending a piece of wire back and forth to break it causes a substantial temperature rise in the area of the bend. This local temperature rise is proportional to the speed of bending. Forming these materials at a high speed is perceived to generate sufficiently high temperatures in the forming area to make it behave as if annealed, and further, if the forming is accomplished in a period of time which is shorter than the stress relaxation constant of that material, the forming limit of the material is substantially improved.

SUMMARY OF THE INVENTION

A method is disclosed for performing a forming operation on a strip of relatively hard material. The method includes the following steps. Tooling is provided having a first tool and a second tool matable with the first tool for performing the forming operation. A stamping and forming machine is provided having the first and second tools coupled thereto. The first tool is arranged to undergo movement toward the second tool into mated engagement therewith and movement away from the second tool out of mated engagement. A strip of relatively hard material is placed between the first and second tools. The stamping and forming machine is then operated so that the movement causes the first tool to move toward the second tool to a first position in engagement with the strip of relatively hard material. And then further to move the first tool to a second position in mated engagement with the second tool thereby completing the forming operation. Wherein the first tool moves from the first position to the second position at a rate sufficiently fast so that the forming operation is completed without cracking the strip of relatively hard material.

DESCRIPTION OF THE PREFERRED EMBODIMENT

When bending a metal member, such as a wire, heat is generated at the site of the bend. It has been discovered that if the bend is performed at very high speed, fracturing that would normally occur does not occur. It is believed that during bending a sufficiently high temperature is developed at the site of deformation that the crystal planes are allowed to slip as though the material were fully annealed. While the effect of strain rate, that is speed of bending, on the ability of the material to withstand large deformation is not well understood, it was found that if the bend is performed in a sufficiently short time, work hardening does not have sufficient time to occur. Therefore, there is no fracturing of the material as a result of the bending operation. For this to occur the time period of the bending operation must be less than the stress relaxation time constant for the material.

Current stamping and forming machines and practices do not provide the speeds necessary for the successful forming of these relatively hard materials. However, an apparatus has been constructed and tested that demonstrates that such forming is easily achievable. This apparatus and the method of the present invention will now be described.

Figure 1:
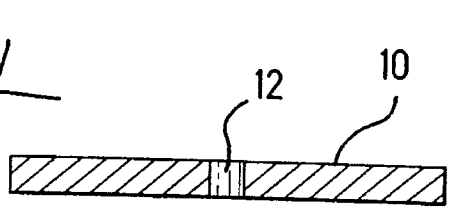
FIG. 1 is a cross-sectional view of a strip of relatively hard material to be formed.
Figure 2:
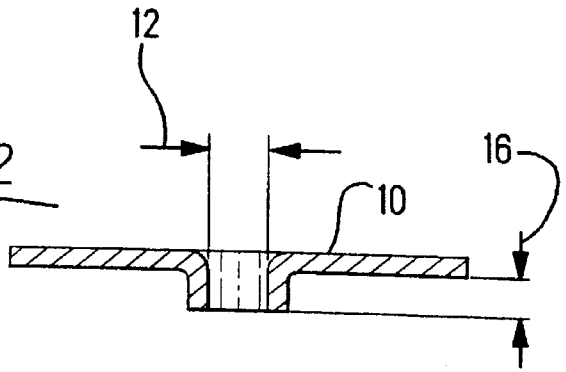
FIG. 2 is a view similar to that of FIG. 1 after forming.
Figure 5:
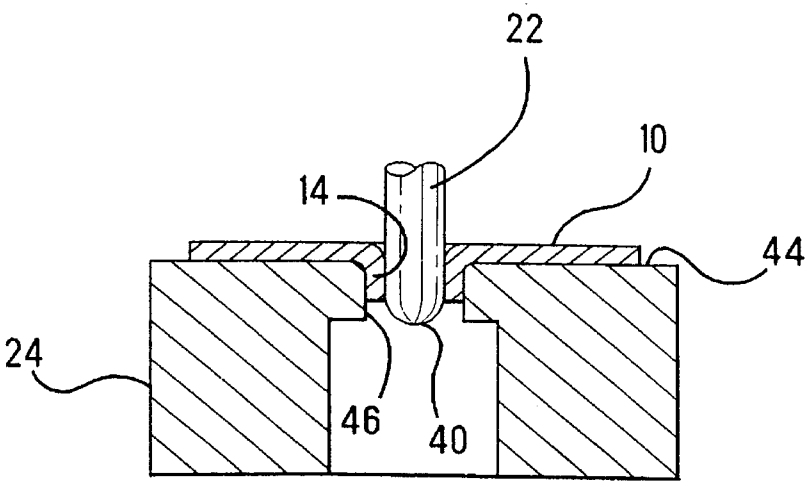
FIG. 5 is a view similar to that of FIG. 4 after forming.
Figure 4:
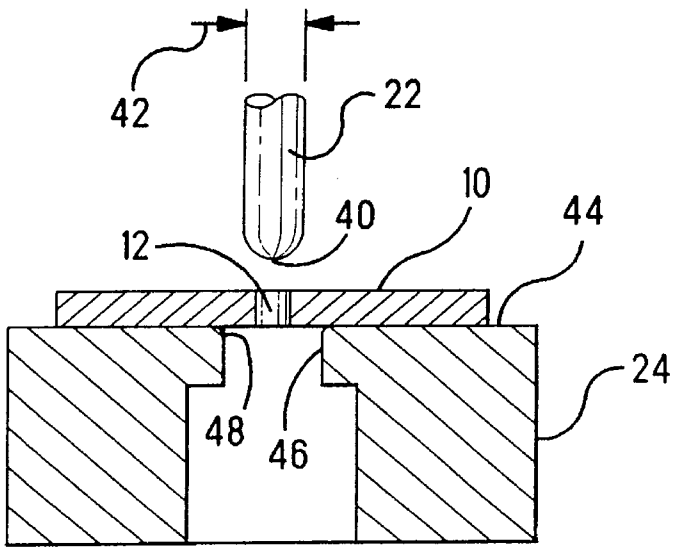
FIG. 4 is an enlarged cross-sectional view of the tooling shown in FIG. 3.
Figure 3:
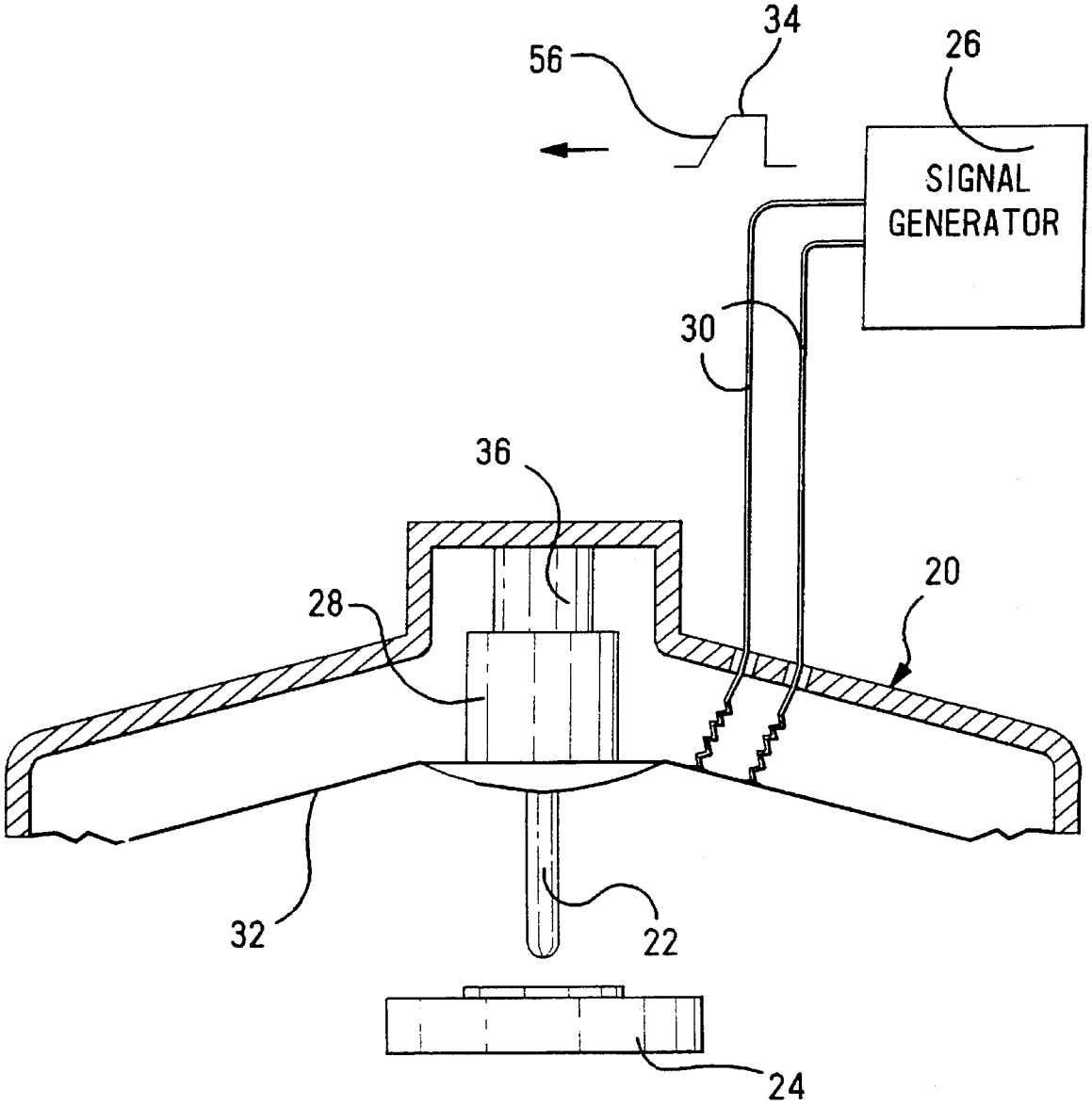
FIG. 3 is a schematic representation of test apparatus for performing the forming operation.

There is shown in FIG. 1 a cross section of a strip 10 of relatively hard material, which in the present example is Paliney 7 in its full hard condition of about 195,000 pounds per square inch ultimate tensile strength, as manufactured by the J. M. Ney Company. The strip 10 is 0.0018 inch thick and includes a starting hole 12 having a diameter of 0.005 inch that extends through the strip. The strip is to be formed to the shape shown in FIG. 2 by deforming the material around the hole 12 downwardly to form an annular flange 14 having an inside diameter of 0.010 inch and a length 16 of about 0.006 inch. An audio speaker 20, as shown in FIG. 3, is used as a transducer to drive a forming tool 22 into mating engagement with a die 24 to form the flange 14. A signal generator 26 is interconnected to a voice coil 28 of the speaker by means of a circuit 30. The voice coil 28 is attached to and drives a movable cone 32 to which the forming tool 22 is attached by any suitable means, such as adhesive. The voice coil 28 is magnetically coupled to a magnetic core 36 in the usual manner so that movement of the cone can be very precisely controlled by controlling the rise time, length, and amplitude of a signal 34 that is transmitted to the voice coil by the signal generator 26 via the circuit 30. As shown in FIG. 4, the forming tool 22 has a somewhat spherical end 40 and a diameter 42 that is substantially equal to the diameter 12, 0.010 inch in the present example. The die 24 includes an upwardly facing die face 44 having a die opening 46 therethrough that conforms to the shape of the forming tool 22 but is sized slightly larger to allow for the desired wall thickness of the flange 14. The upper edge of the die opening 46 includes a radius 48, that is 0.0001 to 0.0005 inch in the present example, as is the practice in the industry to help prevent tearing during the forming process. In operation, the strip 10 is placed on the die surface 44 with the starter hole 12 in alignment with the die opening and the forming tool 22, as shown in FIG. 4. The signal generator 26 is then operated to transmit a single pulse 34 having an amplitude sufficient to drive the cone 32 and attached forming tool 22 so that the tip 40 moves into the die opening 46 to the position shown in FIG. 5. The pulse 34 is shaped to provide a coil travel time of 0.15 millisecond so that after the tip 40 moves into engagement with the strip, it will continue to move to the position shown in FIG. 5 within that time period. That is, the entire forming operation from the time that the tip 40 first engages the strip 10 to the time that the tip is fully mated with the die 24 is about 0.15 millisecond.

A similar forming tool and die were arranged in a conventional stamping and forming machine that included a ram having a stroke of 1.5 inches and operated at 1200 strokes per minute. A strip of full hard Paliney 7, similar to the strip 10, was placed between the forming tool and die and the machine actuated to form a flange similar to the flange 14. The forming tool, after moving into engagement with the strip, required 0.39 millisecond to continue movement to its fully mated positions with the die. This relatively long time period to perform the forming operation was greater than the stress relaxation time constant for the material and the strip fractured at the forming site as expected.

Figure 6:
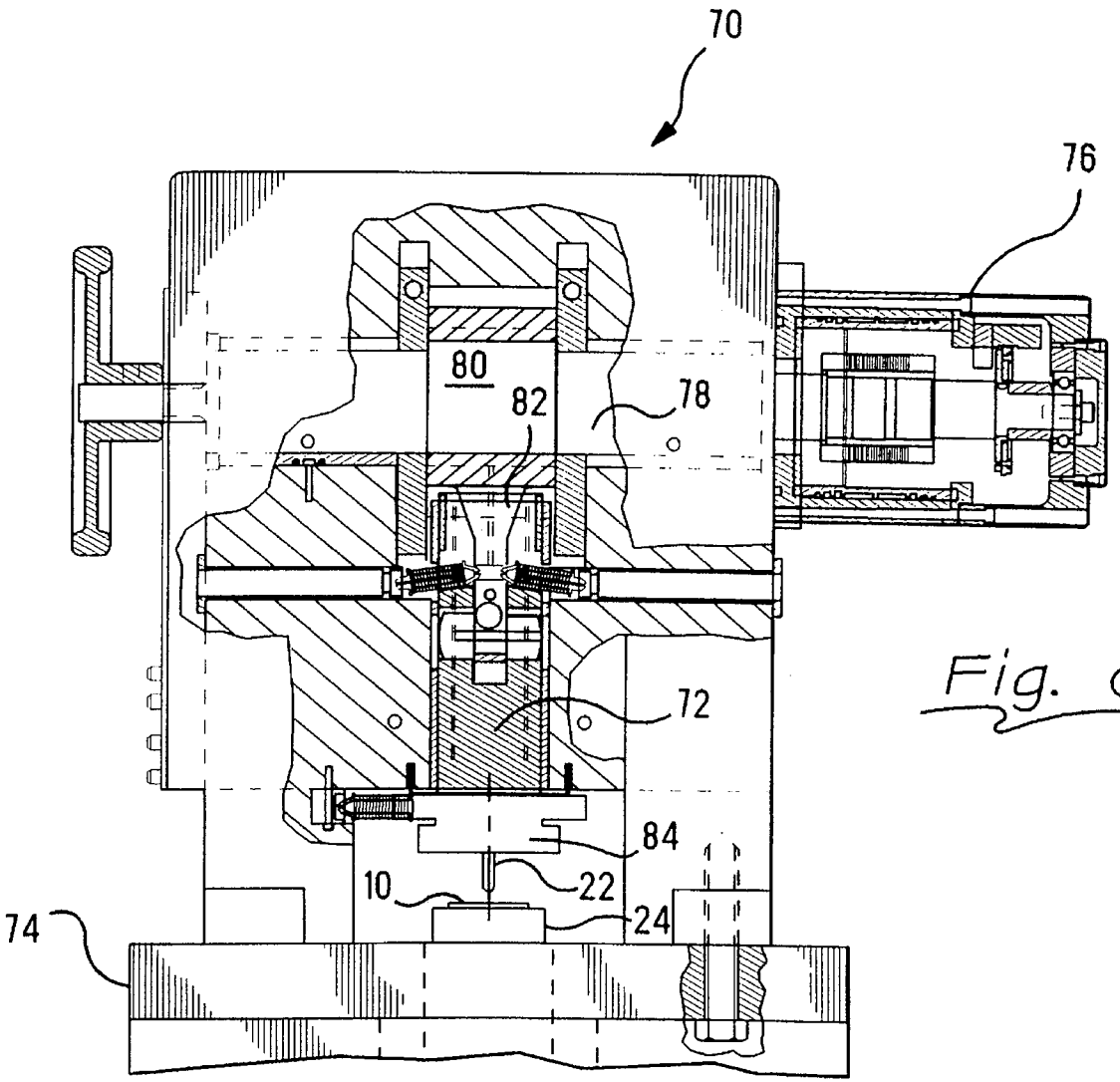
FIG. 6 is a front view in partial cross section of a high speed stamping and forming machine.

While the speaker 20 is suitable for applying the teachings of the present invention to very small parts, a high speed stamping and forming machine having the capability of performing the forming operation in the desired time period of 0.15 millisecond would be more suitable for larger parts such as electrical contacts for electrical connectors. Such a high speed machine 70, shown in FIG. 6, is disclosed in copending patent application Ser. No. 08/496,376, filed Jun. 29, 1995 by the present inventor and assigned to the present assignee, having the title "A MACHINE FOR PERFORMING HIGH SPEED STAMPING AND FORMING OPERATIONS". The high speed machine 70, includes a ram 72 that moves toward and away from a bolster plate 74 at a rate of 6000 strokes per minute. The length of the stroke is 0.4 inch. An electric motor 76 is coupled to a drive shaft 78 having an eccentric 80 which drives the ram by means of a crank 82. The drive shaft and crank are journaled in hydrostatic bearings and the ram in a linear hydrostatic bearing, including unique fluid conduits, all of which are specially designed to allow the machine to operate at such high speed. An upper tooling mount 84 is attached to and carried by the ram 72. The forming tool 22 is secured to this tooling mount 84 and the mating die 24 is secured to the bolster plate 74 in the usual manner.

Figure 7:
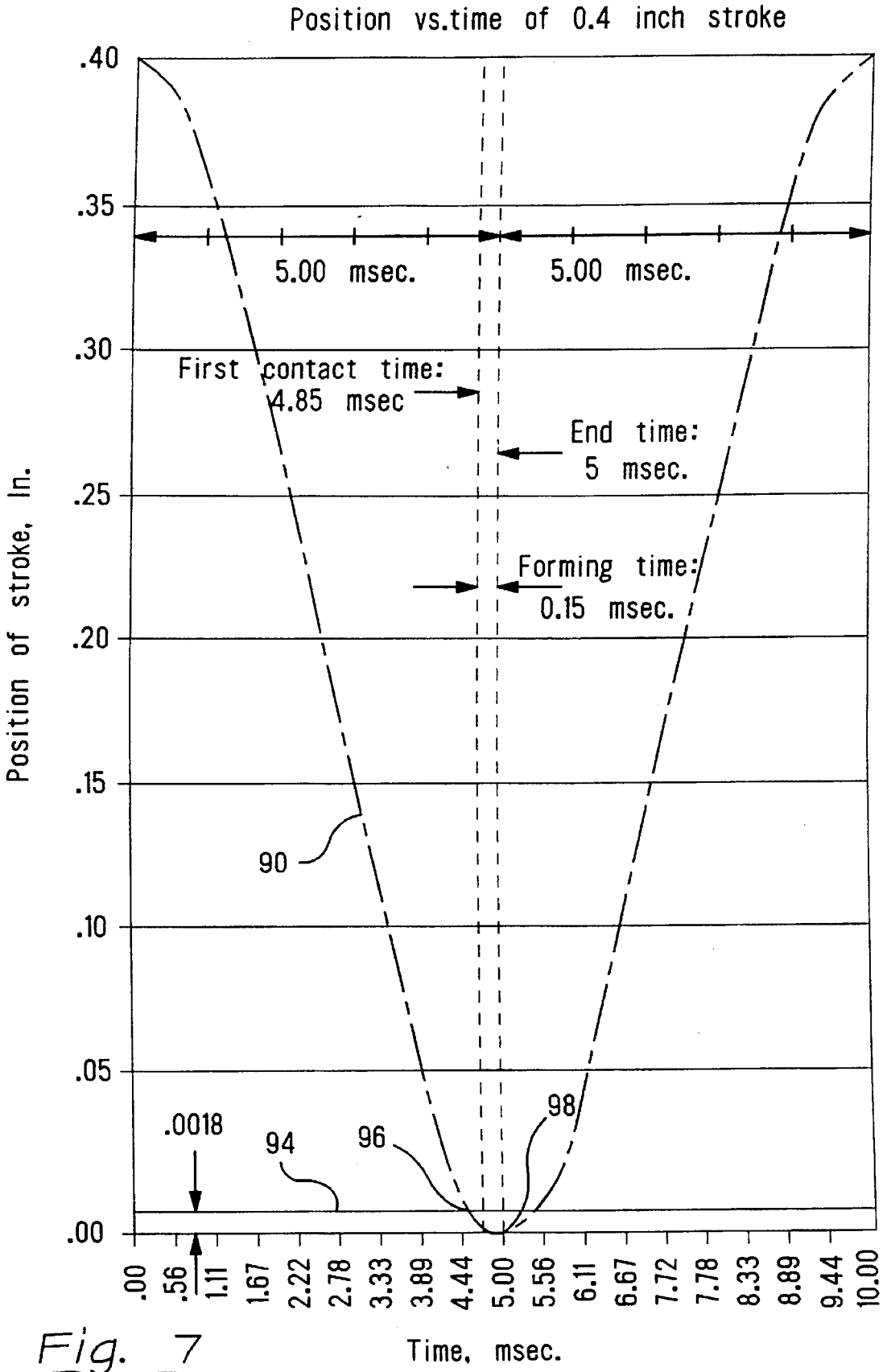
FIG. 7 is a graph showing the relationship of the ram stroke with respect to time in the machine shown in FIG. 6.
Figure 8:
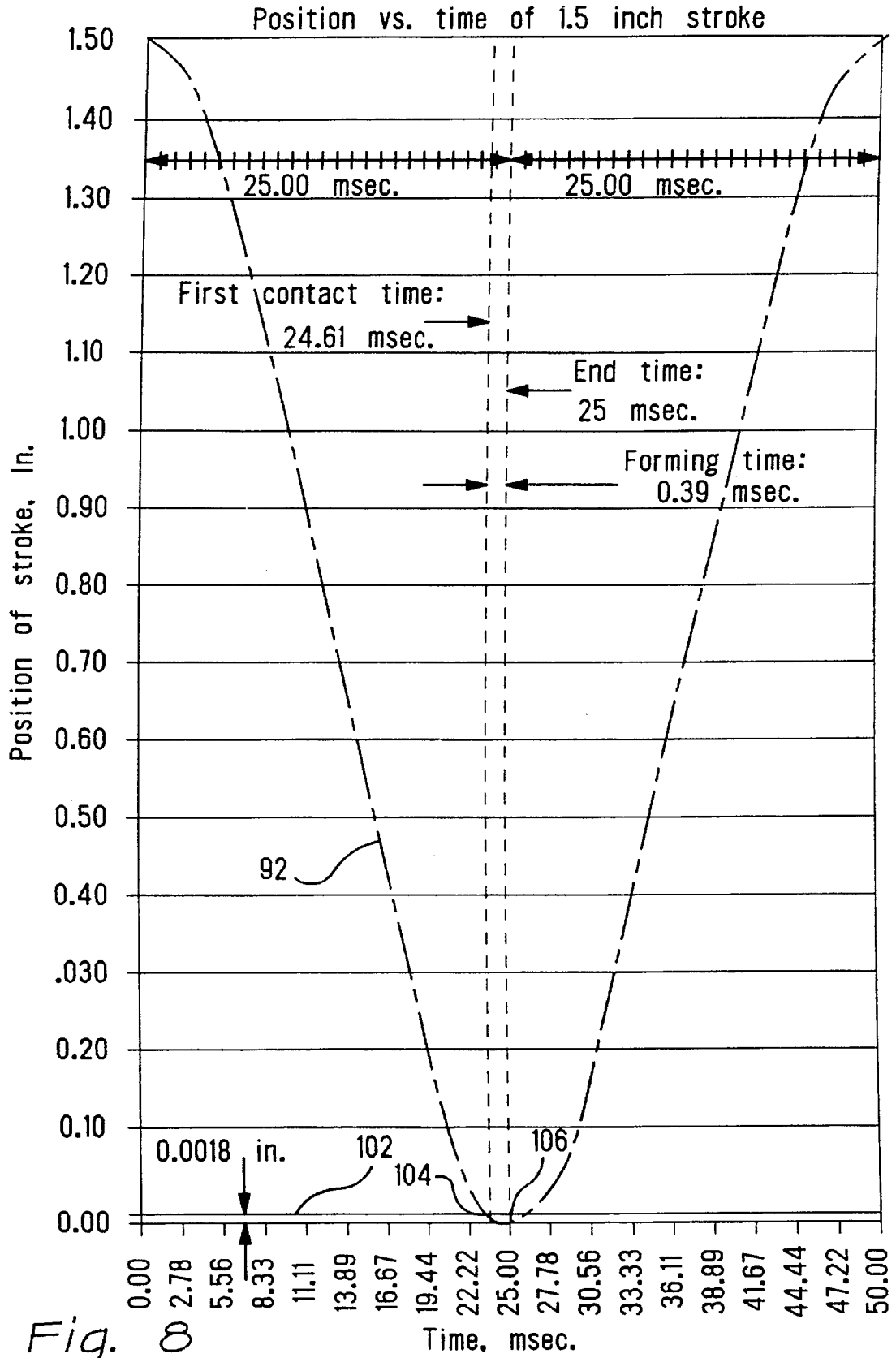
FIG. 8 is a graph showing the relationship of the ram stroke with respect to time in a conventional stamping and forming machine.

These two examples utilizing the stamping and forming machine 70 having a ram stroke of 0.4 inch and operating at 6000 strokes per minute and the conventional stamping and forming machine having a ram stroke of 1.5 inches and operating at 1200 strokes per minute are illustrated in two graphs having curves 90 and 92 shown in FIGS. 7 and 8, respectively. As shown in FIG. 7, the curve 90 depicts the movement of the ram 72 of the machine 70 through its 0.4 inch stroke, along the Y-axis, and the time from 0.00 second to 0.01 second for completing a single stroke, along the X-axis. The point at which the tip 40 of the forming tool 22 first engages the strip 10 is indicated as a line 94 at the 0.0018 point on the Y-axis. The curve 90 intercepts this line at the 4.85 millisecond point along the X-axis as indicated at 96 in FIG. 7. The curve 90 also intercepts the X-axis at the 5.00 millisecond point along the X-axis as indicated at 98. All of the forming takes place between these two points, over a ram displacement of 0.0018 inch and a time period of 0.15 millisecond. The curve 92 shown in FIG. 8, on the other hand, depicts the movement of the ram of a conventional stamping and forming machine through its 1.5 inch stroke, along the Y-axis, and the time from 0.00 second to 0.05 second for completing a single stroke, along the X-axis. The point at which the tip 40 of the forming tool 22 first engages the strip 10 is indicated as a line 102 at the 0.0018 point on the Y-axis. The curve 92 intercepts this line 102 at the 24.61 millisecond point along the X-axis as indicated at 104 in FIG. 8. The curve 92 also intercepts the X-axis at the 25.00 millisecond point along the X-axis as indicated at 106. All of the forming takes place between these two points, over a ram displacement of 0.0018 inch and a time period of 0.89 millisecond. As indicated above, this time period is greater than the stress relaxation time constant for the material of the strip 10 and, therefore, will result in fractures at of near the site of forming.

While the present invention may be practiced by means of the speaker 20, shown in FIG. 3 and the high speed stamping and forming machine 70, shown in FIG. 6, other suitable apparatus may be utilized to perform the forming operation within the critical time period of between about 0.39 millisecond and 0.15 millisecond or less, depending upon the specific material being formed and its stress relaxation time constant. Such other suitable apparatus may include tools operating in a conventional press at conventional speeds but having a speed enhancing mechanism that provides the necessary tool closure rate to assure that the forming occurs within the required time period. Further, while the forming operation exemplified herein is a drawing operation that displaces the material, it will be understood that the teachings of the present invention may be advantageously practiced with other stamping and forming operations that displace the material such as bending, blanking, coining, twisting, upsetting, drawing, and other operations where the material is cut or deformed.

An important advantage of the present invention is that many different relatively hard materials that heretofore were not able to be easily formed can now be considered for use. This allows the use of many alloys, such as beryllium nickel, manufactured by the NGK Metals Company of Reading, Pa., and Paliney 7 that are attractive electrical contact materials that would otherwise not be usable if forming were attempted at conventional forming speeds.

I claim:

1. A method of performing a forming operation on a strip of relatively hard material having a stress relaxation time contant comprising the steps:

(a) providing tooling having a first tool and a second tool matable with said first tool for performing said forming operation;

(b) providing a stamping and forming machine having said first and second tools coupled thereto, said first tool arranged to undergo cyclical movement toward said second tool into mated engagement therewith and away from said second tool out of said mated engagement;

(c) placing a strip of relatively hard material between said first and second tools;

(D) operating said stamping and forming machine thereby effecting said cyclical movement of said first tool toward said second tool to a first position in engagement with said strip of relatively hard material and then further moving said first tool in a second position in mated engagement with said second tool in a defined time period to thereby complete said forming operation, wherein said time period is defined by moving said first tool from said first position to said second position at a rate sufficiently fast so that said forming operation is completed in less than the stress relaxation time constant of the material and without cracking said strip of relatively hard material.

2. The method according to claim 1 wherein said first tool moves from said first position to said second position at a rate of at least about 5 inches per second.

3. The method according to claim 1 wherein said first tool moves from said first position to said second position at a rate of from about 12 inches per second to about 15 inches per second.

4. The method according to claim 1 wherein said cyclical movement in step (d) has a length of about 0.40 inch and said moving of said first tool in step (d) from said first position to said second position occurs over a distance of about 0.45 percent of said cyclical movement length.

5. The method according to claim 4 wherein said first tool moves from said first position to said second position in less than about 0.5 millisecond.

6. The method according to claim 4 wherein said first tool moves from said first position to said second position in less than about 0.2 millisecond.

7. The method according to claim 1 wherein said cyclical movement in step (d) occurs at a rate of about 6000 cycles per minute.

8. The method according to claim 7 wherein said cyclical movement in step (d) has a length of about 0.40 inch and said moving of said first tool in step (d) from said first position to said second position occurs over a distance of about 0.45 percent of said cyclical movement length.

9. The method according to claim 1 wherein said forming operation includes displacing a portion of said strip of relatively hard material.

* * * * *